United States Patent [19]

Jyo

[11] 4,110,992

[45] Sep. 5, 1978

[54] BRUSH-TYPE PACKING MEANS FOR SHIELD EXCAVATOR

[75] Inventor: Shigeru Jyo, Urawa, Japan

[73] Assignee: Tekken Kensetu Co. Ltd., Tokyo, Japan

[21] Appl. No.: 689,722

[22] Filed: May 25, 1976

[30] Foreign Application Priority Data

May 30, 1975 [JP] Japan ..... 50-64166

[51] Int. Cl.[2] ..... E01G 5/16

[52] U.S. Cl. ..... 405/147

[58] Field of Search ..... 61/85, 84, 42, 45 R, 61/63

[56] References Cited

U.S. PATENT DOCUMENTS

| | | | |
|---|---|---|---|
| 646,354 | 3/1900 | Buel | 61/85 |
| 723,986 | 3/1903 | Carson | 61/85 |
| 3,410,098 | 11/1968 | Winberg | 61/85 |
| 3,979,920 | 9/1976 | Burgess et al. | 61/85 |

FOREIGN PATENT DOCUMENTS

| | | | |
|---|---|---|---|
| 1,529,828 | 5/1968 | France | 61/85 |
| 1,197,914 | 8/1965 | Fed. Rep. of Germany | 61/85 |

*Primary Examiner*—Dennis L. Taylor

*Attorney, Agent, or Firm*—Burns, Doane, Swecker & Mathis

[57] ABSTRACT

A brush-type packing means for shield tunnel excavators which is high in wear resistance and sealing effect against under ground water is provided. The packing means comprises a resilient wire brush secured substantially in a ring shape along the inner periphery of a substantially cylindrical excavator body adjacent its tail end or the peripheral edge of the tunnel entrance on the wall surface of the vertical shaft to close a gap space between the tail end or the entrance edge and the peripheral surface of a tunnel wall element inserted in an excavated tunnel, and clearances between respective brush wires are sealed with an impregnating agent which is deformable and impermeable to water.

12 Claims, 5 Drawing Figures

BRUSH-TYPE PACKING MEANS FOR SHIELD EXCAVATOR

This invention relates to brush-type packing means for shield tunnel excavators.

So many sewerage and underground railway constructing works are being carried out today in and around cities that so-called shield type tunnel excavations are employed extensively. However, in most of them, such packing means employed at the tunnel entrance and tail end of the excavator as will be later described is incomplete so that so-called back filling of cement mortar or the like into a space made in the ground around tunnel wall elements is difficult to perfectly carry out, whereby ground collapse will be readily induced and serious accidents will be likely to be caused in and around cities under which various pipes are embedded many in every direction.

References shall be made more specifically to the packing to which the present invention relates with reference to FIG. 1 showing schematically an example of simple and short distance tunnel excavating work, in which a vertical shaft 1 is first dug vertically to the ground surface and, when a desired depth is reached, a tunnel is horizontally made employing, in the case shown in FIG. 1, a cylindrical metal head 2 for excavation at the forward end and concrete Hume pipes 2' of a smaller diameter and sequentially following the metal head 2 as butted endwise to each other, which are horizontally pressed on the rear end surface by a press ring means 3 driven by jacks 3' while removing the soil or the like out of the Hume pipes 2' to the ground surface. In this case, as there is a difference between the respective outer diameters of the head 2 and Hume pipes 2' so that the first Hume pipe butted to an the head 2 will engage at an end to the inward projection fixed to inner periphery of the head 2 adjacent its tail end, a gap space corresponding to this diameter difference is caused to be produced as the tunnel excavation advances and a cement mortar layer 6 is formed in the gap space by injecting a cement mortar into the space through holes provided in the body of the Hume pipes for preventing any collapse of ground layer at such space. This gap space is of course made at the initial entrance point of the tunnel excavation on a side wall 4 of the vertical shaft 1 and, in order to prevent any flow out of the soil or the like as well as under ground water at the initial stage and of the cement mortar at a later stage through the space, a packing means 5 is provided to seal the gap space between an edge part of the side wall 4 of the vertical shaft 1 and the outer periphery of the Hume pipes 2'. It will be readily understood that even in the case when an excavator having a rotary cutter head is used at the tunnel face, instead of the cylindrical head 2, for cutting the ground layer by the cutter head and conveying the excavated soil or the like onto the ground surface and the periphery of the excavated tunnel is reinforced by concrete or the like segments, such packing means will be required to seal the gap space.

As the above described packing means, a plate-shaped packing of such material as a natural rubber, urethane rubber or synthetic rubber has been conventionally used. However, this kind of rubber material has such a high wear factor that the packing must be replaced quite often and, due to the shape of the plate-shaped resilient packing, it is difficult to maintain an intimate engagement of the respective packing plates with the outer periphery of the Hume pipe or tunnel wall segment to achieve a complete packing, and stones or the like objects may be readily held and remain between the packing and the pipe or segment so that the back filling material, flowing sand, mud water or the like will leak through the packing, whereby, not only the working efficiency will be remarkably reduced, but also the ground layer collapse will be readily caused to occur.

The above has been referred to the case of so-called entrance packing employed between the tunnel entrance edge at the vertical shaft and the outer periphery of the excavator body of various type or of the Hume pipe or tunnel wall segment, but the same problems as disclosed above commonly apply to the case of so-called tail packing employed in the similar manner between the inner periphery of the excavator at its tail end and the outer periphery of the pipe or segment butted to the excavator.

In order to improve the packing means in respect of such defects as described above of the plate-shape packing of rubber or the like resilient material, there have been suggested certain brush-type packing employing rigid but resilient wire brushes of such wire material as nylon string, hard steel wire, piano wire, stainless steel wire or the like so that the packing will be higher in wear resistance and also in sealing or packing efficiency as compared with the plate-shaped rubber packing. In FIG. 2, there is shown an example of such known brush-type packing means, in which case the means is shown as the tail-packing so that any gap clearance between the inner periphery of the excavator body and the Hume pipe or tunnel wall segment will be closed by the brush wires to prevent any soil or the like and under ground water as well from leaking into the tunnel through a joint part of these members. In the drawing, many flat bunched packings of wire brushes 13 having a resiliency and wear resistance are placed around the entire inside periphery of a tail skin plate 12 of a cylindrical excavator body 11 and held adjacent one end of the respective bunches by means of a holding plate 14 fixed to the skin plate 12 by bolts 15. A channel member 16 holds tightly the end of each bunch of the brush 13. The other free end of the brush packing 13 is oriented inward so that the wire will be resiliently bowed as shown and engage the chain line with peripheral surface of a Hume pipe or wall-segment 17 shown by a straight chain line 17 to close the clearance. According to this arrangement, the respective wires of the brush packing 13 will evenly contact the periphery of the pipe or segment 17 achieving a prevention of the leakage of the soil or the like and, even in the case of a water containing ground layer, the brush wires will cause the capillary phenomenon of water to occur therebetween so as to prevent substantially thereby any water leakage. While this type of brush packing is advantageous in achieving the even and intimate engagement with the pipe or segment periphery in addition to the higher durability, however, the brush bunch must be thick and dense to achieve the water leakage prevention so as to be utilizable even in the case of a ground of much higher water content but, when relatively large stone material or the like is held in the brush wires, the respective wires tend to be thereby separated from each other to cause a clearance around such stone material or the like allowing water to leak therethrough.

In order to improve the brush-type packing in the above respect, there is suggested another brush-type packing means as shown in FIG. 3, in which case annular fitting plate 23 is annularly secured by welding or any other means to the inside surface of a skin plate 22 of a body 21 of the shield excavator, and a plurality of brush type packings 24 of metal wires which are respectively crimped and bundled are bent in the middle of their length around a core wire 25 by means of tieing wire 26 and secured along the plate 23 with pressing plates 28 respectively having a recess 27 and bolts 29. In this example, as the metal wires 24 are crimped or waved so as to be entangled with each other they produce a netting action providing an increased packing effect. However, this brush-type packing means with the crimped wires is still incomplete when the means encounters ground having a very high water content accompanying high water pressure, or specifically when a relatively large stone or the like object is caused to be held by the brush, in which cases the water leakage prevention cannot be made to depend upon the capillary phenomenon or the brush wires entangled with each other still tend to produce a clearance around the stone or the like object.

The present invention has been suggested to remove successfully such defects in the conventional packing means as described in the foregoing, by providing a brush-type packing means employing wires highly resilient and wear resistive and clearances between which are substantially sealed with an impregnating agent in the form of an organic matrix having a deformability and impermeability to water.

A primary object of the present invention is, therefore, to provide a brush-type packing means for a shield tunnelling excavator which has a high degree of resiliency and a high degree of durability and achieves a higher packing efficiency.

A related object of the present invention is to provide a brush-type packing means for a shield tunnelling excavator which enables excavation of the tunnel with a high safety factor preventing any collapse in the ground layer and thus with a higher efficiency.

Other objects and advantages of the present invention will be made clear by references to the following disclosures of the present invention detailed with reference to certain preferred embodiments as illustrated in accompanying drawings, in which.

Figure 1:
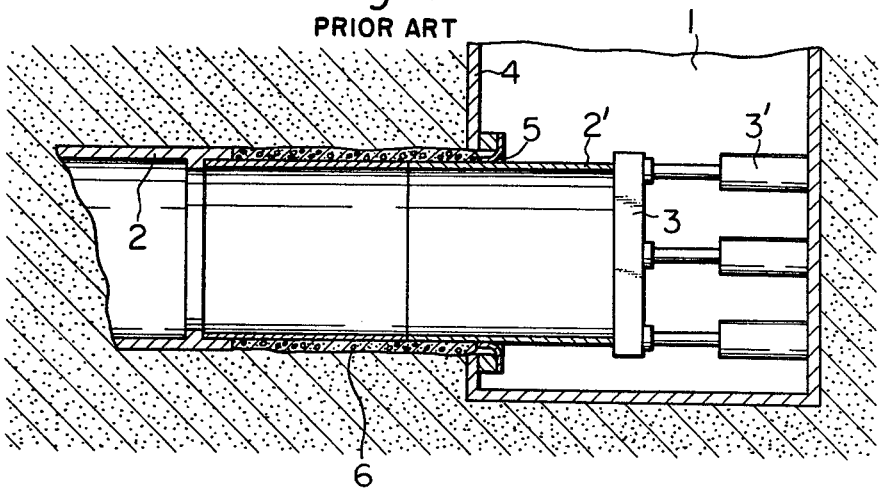
Fig. 1 PRIOR ART
FIG. 1 is a schematic view showing an example of usages of general packing means for a simple tunnel excavation.
Figure 2:
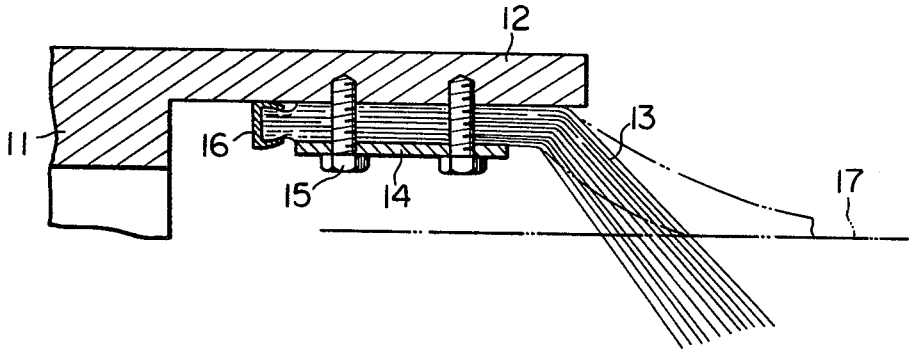
Fig. 2 PRIOR ART
FIGS. 2 and 3 are fragmentary enlarged sectioned views of conventional packing means in other usage.
Figure 3:
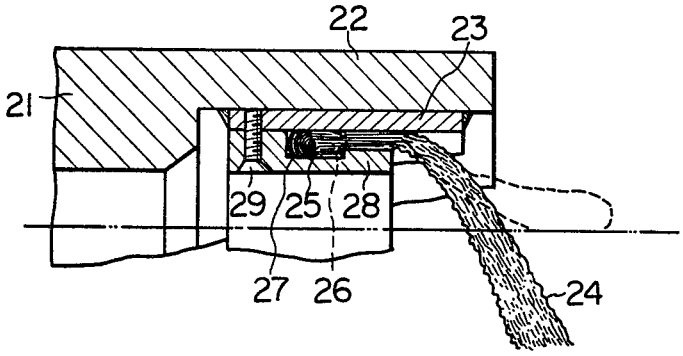
Fig. 3 PRIOR ART
Figure 4:
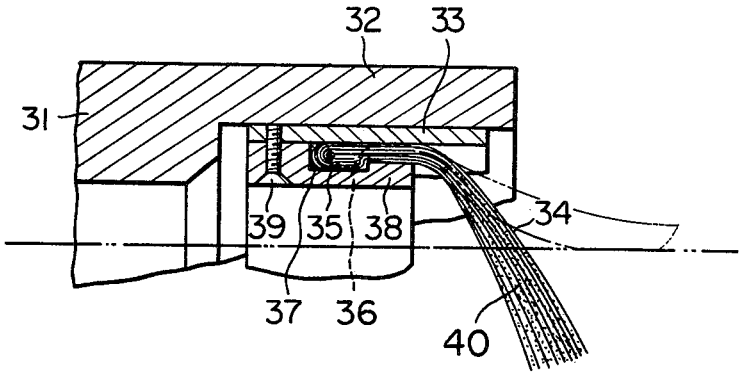
FIG. 4 is a similar sectioned view showing an embodiment of the present invention in the case of the same usage as in FIGS. 2 and 3.

Referring now to FIG. 4 showing an embodiment of the brush-type packing means of the present invention as applied to the case of the tail packing provided on the tail end side of a cylindrical body 31 of an excavating head or a shield excavator, preferably a fitting plate 33 is secured annularly to the inner peripheral surface of a skin plate 32 of the body 31 along and adjacent the tail end edge of the body by welding or any other proper means, and a resilient metal wire brush 34 flat brush-shaped by, in the present instance, folding back wires substantially in the middle of their length around a ring-shaped core wire 35 and bunching them with a tieing wire 36 is fixed against the fitting plate 33 and held by a pressing plate 38 having a recess 37 for housing the folded back end of the brush and secured to the plate 33 by means of bolts 39. Normally, it is advantageous to divide the brush 34 and pressing plate 38 respectively into a plurality of peripheral sections so that their manufacture and mounting may be easy and partial exchange of any worn brush with new one if required may be easily performed. In this embodiment, respective clearances between the metal wires of the brush are substantially sealed with an impregnating agent 40 consisting of an organic matrix material impermeable to water such as gelatin, cellulose or a synthetic resin. In the present instance, the brush clearances are impregnated with the agent in a liquid state by means of an injection gun under a pressure and the agent is set at the normal temperature to bind the metal wires substantially integrally and resiliently. It is of course desirable to select, as the impregnating agent, a material which will have a proper resiliency even after the same is set.

With this arrangement, the substantially integrally and resiliently bound metal wires of the brush-type packing means achieve a substantially complete packing effect against a highly water containing ground layer while performing resilient and intimate engagement with the Hume pipe or tunnel wall segment.

Figure 5:
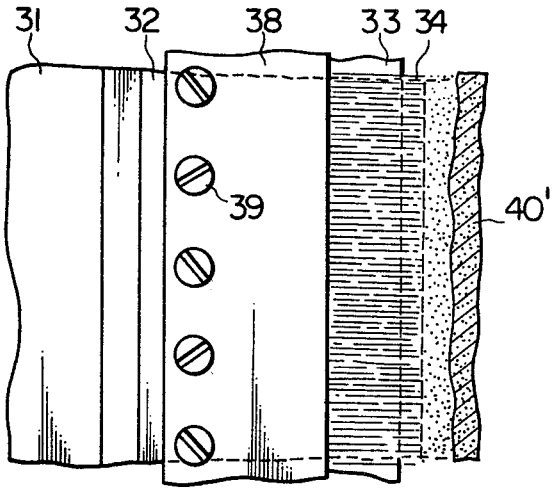
FIG. 5 is a fragmentary plan view of another embodiment of the present invention.

In the case of another embodiment as shown in FIG. 5, the same impregnating agent as in the foregoing is applied to one side surface of the brush wires 34, preferably on the outer side with which the wires contact the back filling agent or flowing soil or the like, so as to form a layer as denoted by a reference 40' in the drawing. Steel wool or any other fibrous material or a foaming agent may be mixed in the impregnating agent.

In these embodiments, as the metal wires are connected with one another through the impregnating agent, the water-permeability will be interrupted and, as an impregnating agent which is resilient even after being set is used, the metal wires will be high in conformability and flexibility, while the impregnating agent will serve also to prevent corrosion of the metal wires.

While the present invention has been described mainly with reference to the entrance packing at the tunnel entrance in the vertical shaft and the tail packing between the excavator and tunnel wall elements, the packing means can be similarly used around a rotary cutter head in the shield slurry type tunnelling excavator as provided preferably at the head end side of the cylindrical excavator body.

It will be also appreciated that the metal wires to be used in the present invention are not to be limited to straight wires but crimped metal wires may be also employed.

It should be further appreciated that, while the brush wires are mainly shown as secured flat and bent inward and in order to achieve this arrangement the wire materials will be required normally to be preliminarily bent before being secured, an angled securing means instead of the flat pressing plate as shown may be employed for securing straight wires and simultaneously orienting the wires inward.

What is claimed is:

1. A brush-type packing means for shield tunnel excavators comprising a substantially ring-shaped brush of bunched wires having a high resiliency and wear resistance, said ring-shaped brush being secured along the inner periphery of a substantially cylindrical excavator body adjacent the tail end thereof and projected inward at its free end, and means for securing said brush to a position for closing a gap between a tunneled ground surface and the peripheral surface of a tunnel wall element inserted in the excavated tunnel, clearances between said bunched wires being sealed with an impregnating agent deformable and impermeable to water, said impregnating agent being substantially filled in said brush wire clearance while being in a liquid state and thereafter set at the normal temperature providing a resiliency.

2. The packing means according to claim 1 wherein said ring-shaped brush and brush securing means are divided into a plurality of sections.

3. The packing means according to claim 1 wherein said impregnating agent is an organic matrix having a fluidity in its molten state and a resiliency in its set state.

4. The packing means according to claim 1 where in said impregnating agent for sealing clearances between the brush wires is applied to at least one side of said brush while being in a liquid state and set at the normal temperature to form a resilient layer on said side.

5. The packing means according to claim 4 wherein said impregnating agent is an organic matrix material having a fluidity in its molten state and a resiliency in its set state.

6. The packing means according to claim 4 wherein said impregnating agent consists of an organic matrix material and having a fluidity in its molten state and a resiliency in its set state and a fibrous material which is wear resistive mixed with said material.

7. The packing means according to claim 1 wherein said ring-shaped brush is secured along the peripheral edge of an entrance hole of said tunnel at a wall surface of a vertical shaft from which the tunnel is excavated.

8. The packing means according to claim 1 wherein said wires are respectively crimped and entangled with each other.

9. The packing means according to claim 1 wherein said bunched wires are made from hard steel.

10. The packing means according to claim 1 wherein said bunched wires are made from stainless steel.

11. The packing means according to claim 1 wherein said bunched wires are made from a synthetic resin.

12. The packing means according to claim 1 wherein said bunched wires are made from piano wire.

* * * * *